US007214203B2

(12) United States Patent
Hwang

(10) Patent No.: US 7,214,203 B2
(45) Date of Patent: May 8, 2007

(54) CARDIOPULMONARY RESUSCITATION APPARATUS

(76) Inventor: Sung-Oh Hwang, Department of Emergency Medicine, Wonju College of Medicine, Yonsei University 162, IIsan dong, Wonju-City, Gangwon-Do, 220-701 (KR)

( * ) Notice: Subject to any disclaimer, the term of this patent is extended or adjusted under 35 U.S.C. 154(b) by 202 days.

(21) Appl. No.: 10/485,770

(22) PCT Filed: Sep. 2, 2002

(86) PCT No.: PCT/KR02/01656

§ 371 (c)(1),
(2), (4) Date: Feb. 4, 2004

(87) PCT Pub. No.: WO03/024336

PCT Pub. Date: Mar. 27, 2003

(65) Prior Publication Data

US 2004/0181179 A1 Sep. 16, 2004

(30) Foreign Application Priority Data

Sep. 21, 2001 (KR) ..... 2001-58583
Mar. 28, 2002 (KR) ..... 2002-17060

(51) Int. Cl.
*A61H 31/00* (2006.01)

(52) U.S. Cl. ..... 601/41; 601/DIG. 6

(58) Field of Classification Search ..... 601/44, 601/41, 108, 151
See application file for complete search history.

(56) References Cited

U.S. PATENT DOCUMENTS

| | | | | |
|---|---|---|---|---|
| 4,338,924 | A | 7/1982 | Bloom | |
| 4,928,674 | A | 5/1990 | Halperin et al. | |
| 5,287,846 | A * | 2/1994 | Capjon et al. | 601/44 |
| 5,769,800 | A | 6/1998 | Gelfand et al. | |
| 6,066,106 | A * | 5/2000 | Sherman et al. | 601/41 |
| 6,645,163 | B2 * | 11/2003 | Kelly et al. | 601/41 |
| 2005/0148909 | A1 * | 7/2005 | Weil et al. | 601/41 |
| 2005/0273023 | A1 * | 12/2005 | Bystrom et al. | 601/44 |

FOREIGN PATENT DOCUMENTS

| | | |
|---|---|---|
| KR | 1998-071916 | 10/1998 |
| KR | 10-0270596 | 8/2000 |

* cited by examiner

*Primary Examiner*—Danton DeMille
(74) *Attorney, Agent, or Firm*—Dickstein Shapiro LLP

(57) ABSTRACT

The invention relates to a cardiopulmonary resuscitation apparatus comprising: a device having a piston for compressing the sternum; and a device for thoracic constriction having a chest band for fastening and constricting the chest when the piston compresses a patient's chest, characterized in that the length of the chest band can be adjusted according to the size of the patient's chest. The apparatus further includes a protection pad to be attached to the chest when the chest band is tightened, thereby easily adjusting the length of the chest band according to the size of the patient's chest and protecting the patient's chest when it is compressed.

5 Claims, 21 Drawing Sheets

PRIOR ART

CARDIOPULMONARY RESUSCITATION APPARATUS

FIELD OF THE INVENTION

The present invention relates to a cardiopulmonary resuscitation (CPR) apparatus, and more particularly, to a cardiopulmonary resuscitation apparatus adapted to artificially trigger the circulation of blood flow of a patient whose heartbeats are stopped.

BRIEF DESCRIPTION OF THE PRIOR ART

Generally, the method of cardiopulmonary resuscitation serves to provide blood flow to the entire human body in lieu of functions of heart and lung, which includes external chest compression and artificial respiration.

In order to restore spontaneous circulation, coronary perfusion pressure needs to be maintained above 20 mmHg during cardiopulmonary resuscitation. Standard CPR can usually generate only 15–20% of normal cardiac output, which is inadequate to restore spontaneous circulation in the majority of patients. Therefore, a variety of CPR techniques and/or apparatuses have been disclosed to enhance blood flow.

One of the CPR apparatuses was filed by the present applicant and registered as Korean Patent No. 270596.

The aforementioned Korean Patent No. 270596 is a CPR apparatus provided with sternal compression and thoracic constriction means that simultaneously functions as a cardiac pump for compressing the sternum and as a thoracic pump for constricting the thorax, thereby supplying a large amount of blood flow.

As illustrated in FIG. 1, the sternal compression and thoracic constriction means 1 includes a piston 6 for compressing sternum 4 of a patient 2, and a chest band 10, both ends of which are wound on a plurality of rollers 8 to be coupled to both lateral surfaces of the piston 6, for encompassing, constricting or relaxing the chest of the patient 2 in response to movement of the piston 6.

In the apparatus thus described in the Patent No. 270596, when the piston 6 descends, the piston 6 compresses the sternum to function as a cardiac pump and, at the same time, the chest band 10 secured at both ends thereof to the piston 6 fastens the chest, which additionally enhances a rise of intrathoracic pressure, thereby increasing the amount of the blood flow and promoting the effect of CPR.

However, there is a problem in the patent No. 270596 in that the length of the chest band not easy adjustable and it takes a long period of time to adjust the chest band such that CPR cannot be performed within a short period of time, resulting in the fear of losing a patient's life, because the chest band should be adjusted according to a patient's physique to allow the thoracic pump to properly function.

There is another problem in that the chest band moves, potentially causing damage to the patient's body when the piston moves vertically to compress the patient's sternum and the chest band constricts the thorax.

SUMMARY OF THE INVENTION

The present invention provides a cardiopulmonary resuscitation apparatus adapted to easily adjust a chest band according to the patient's physique to maintain effective sternal compression and chest constriction simultaneously.

The present invention further provides a cardiopulmonary resuscitation apparatus adapted to protect the chest from the chest band when a patient's chest is constricted.

In accordance with an embodiment of the present invention, a cardiopulmonary resuscitation apparatus comprises sternal compression means having a piston for compressing a patient's sternum; thoracic constriction means having a chest band for fastening and constricting the chest when the compression means compresses the sternum; and length adjusting means for adjusting the length of the chest band according to the size of the patient's chest. The length adjusting means includes: a bobbin for getting the chest band wound on; a first ratchet wheel inserted and fixed at a bobbin axle; a first stopper meshed to the first ratchet wheel for preventing reverse rotation of the bobbin; a handle bracket inserted at the bobbin axle for free rotation, coupled with the first stopper to be guided and with a second ratchet wheel coupled at one side thereof; a second stopper meshed to the second ratchet wheel for restricting the rotation of the handle bracket; and a spiral spring for giving rotational force to the bobbin.

The thoracic constricting means further includes a protection pad to be attached to the chest when the chest band is tightened.

The sternal compressing means further includes: a stopper having a plurality of restricting grooves for adjusting a dropping level of the piston; and a restricting member hitched at the restricting groove in descending along with the dropping piston.

In accordance with another embodiment of the present invention, the cardiopulmonary resuscitation apparatus comprises sternal compression means having a piston for compressing a patient's chest; and thoracic constriction means having a chest band for fastening and constricting the chest when the compression means compresses the chest, wherein the chest band includes: left and right chest bands divided for respectively winding around the left and right parts of the chest, a main body having a support side for securely placing and supporting a patient's back and length adjusting means assembled at the main body for adjusting the length of the chest band according the size of the patient's chest, the length adjusting means further including; left and right bobbins for getting the left and right chest bands wound on after insertion through the center of the support side; a spiral spring for giving restoring force to the left and right bobbins; a plurality of electric gears mounted to the left and right bobbins for rotating the left and right bobbins; and driving means for driving the electric gears and locking means for restricting the rotation of the electric gears.

The driving means includes a driving gear meshed to the electric gears for rotation, a driving axle coupled with the driving gear, a handle axle spline-fastened at the driving axle for attachment and detachment and a handle fastened at the handle axle.

The driving means may include a driving gear meshed to the electric gears for rotation, a driving axle coupled with the driving gear, and a motor for being controlled by control means to rotate the driving axle.

The driving means may include a center gear meshed to the electric gears for rotations, a driving axle coupled with the center gear, a driving gear inserted at the driving axle and a cylinder having a rack gear for rotating the driving gear.

The thoracic constriction means includes a protection pad for being attached to the chest when the chest band is fastened and an elastic skin protection band attached at the internal side of the chest band for protecting the patient's skin.

BRIEF DESCRIPTION OF THE DRAWINGS

The objects and aspects of the invention will become more apparent from the following description of preferred embodiments with reference to the accompanying drawings in which.

DETAILED DESCRIPTION OF THE INVENTION

Figure 1:
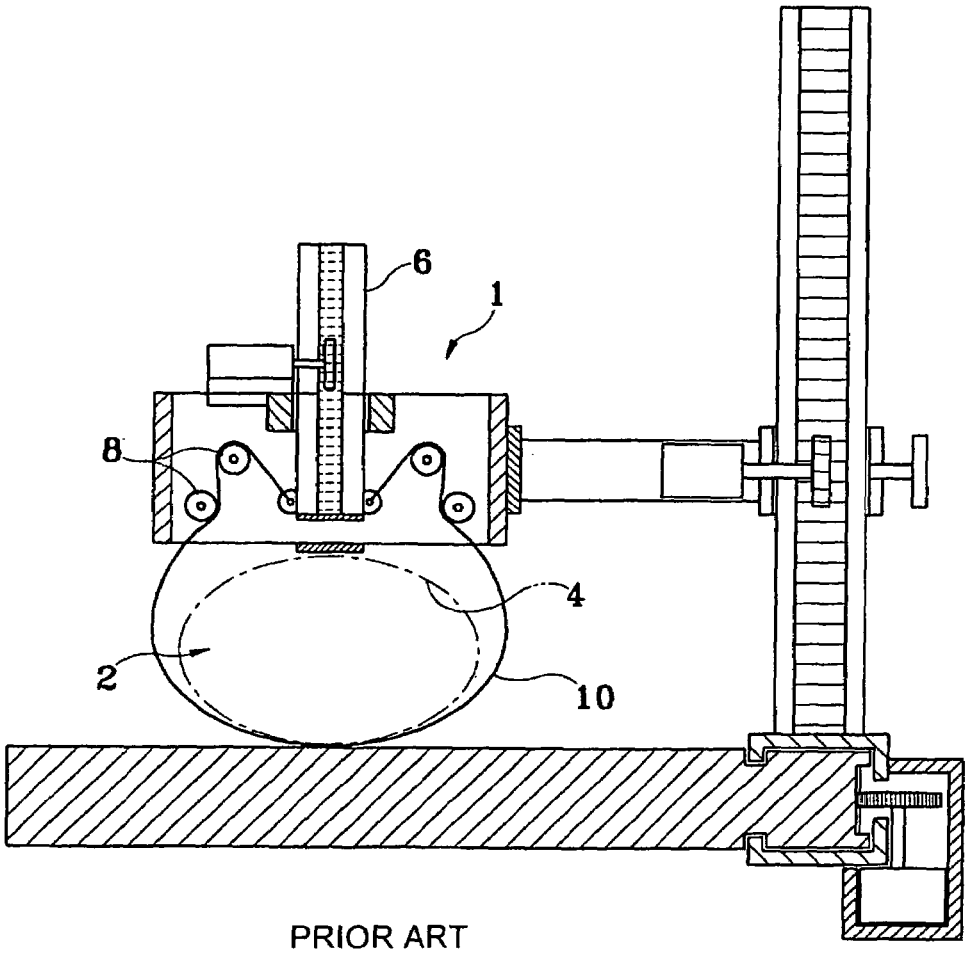
FIG. 1 is an elevation view for illustrating a conventional cardiopulmonary resuscitation apparatus.

FIG. 1 illustrates a conventional cardiopulmonary resuscitation apparatus, discussed above in the Description of the Prior Art.

Figure 2:
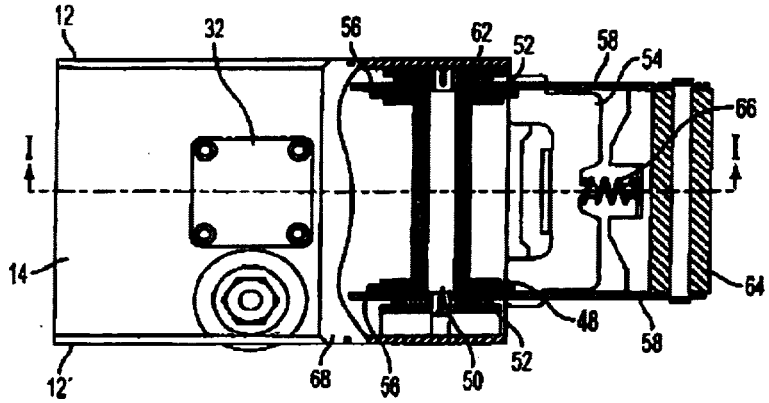
FIG. 2 is a plane for illustrating the cardiopulmonary resuscitation apparatus in accordance with the first embodiment of the present invention.
Figure 3:
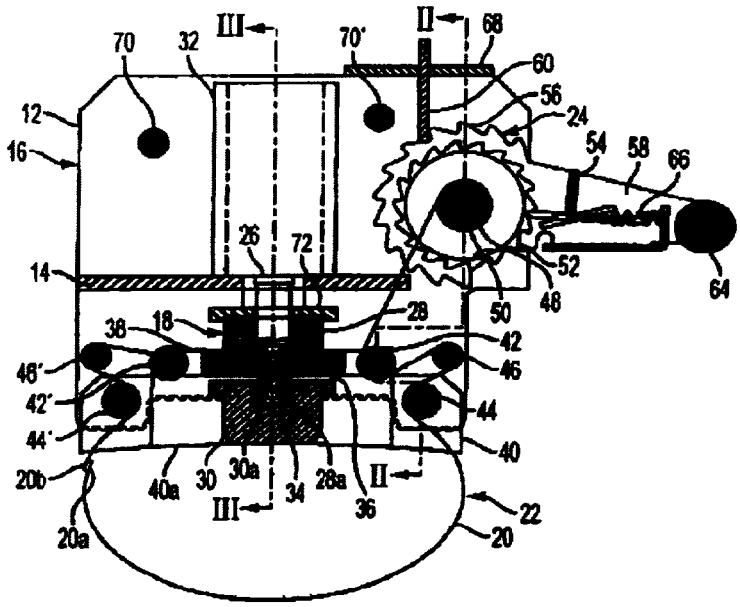
FIG. 3 is a cross-sectional view cut along arrow line I—I shown in FIG.2.

As shown in FIGS. 2 and 3, two vertical, lateral plates 12, 12' are connected by a horizontal center plate 14, so that a frame 16 is constructed with a predetermined gap between the two vertical lateral plates 12, 12'. The frame 16 includes: first compression means 18 for compressing the sternum, second compression means 22 having a chest band 20 for fastening and constricting the chest when the first compression means compresses the sternum and length adjusting means for adjusting the length of the chest band 20 according to the size of the patient's chest.

The first compression means 18 includes a compression pad 30 coupled with a piston 26 protruded downward at the horizontal center plate 14 via a medium member 28. The piston 26 is embedded in a cylinder 32 and is operated by air pressure. The compression pad 30 may be coupled directly with the piston 26.

The piston 26 may have a spring inserted at the internal side of the cylinder 32 for being operated by air pressure when it goes forward (drops) and operated by the restoring force when it goes backward (rises). On the other hand, the piston 26, as disclosed in Patent No. 270,596, includes a rack at one side thereof and can be operated by a motor that rotates a pinion toothed with the rack.

The medium member 28 is fixed at a connection plate where a guide roller, which will be described below, is coupled, and a hitching block 34 is mounted at an end of the protruder 28*a* extended down to the medium member 28 for being inserted and hitched to the compression pad 30.

The compression pad 30 includes a groove 30*a* where the hitching block 34 is inserted, and the hitching block 34 is hitched by a cover 36 that covers a partial upper portion of the groove 30*a*.

The second compression means 22 includes a connection plate 38 fixed at the medium member 28, a plurality of rollers at both sides of the connection plate 38 and at both lower sides of the vertical lateral plate. When the chest band 20 guided by the rollers is wrapped around a patient's chest and fastened, protection pads 40, 40' are closely related to the patient's chest.

At this time, the rollers guiding the chest band 20 are classified into first guide rollers 42, 42' coupled at both sides of the connection plate 38, second guide rollers 44, 44' coupled at both lower sides of the vertical lateral plates 12, 12' and idle rollers 46, 46' coupled between the first and second guide rollers.

Figure 6:
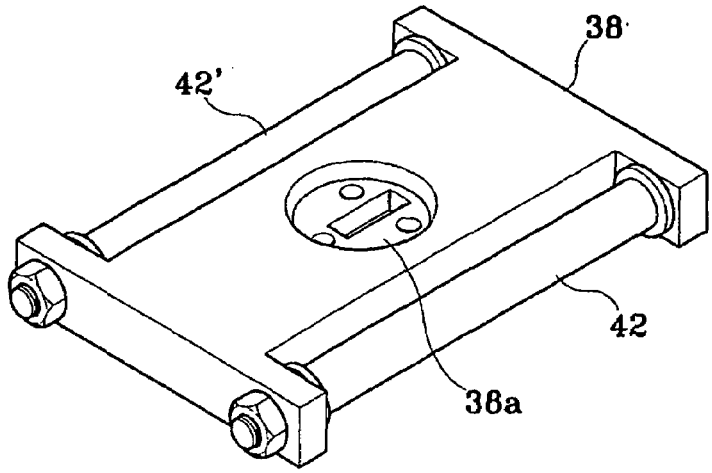
FIG. 6 is a perspective view for illustrating a first guide roller mounted on a connection plate shown in FIG. 3.

As shown in FIG. 6, a fixing groove 38*a* is formed at the center of the connection plate 38 for insertion and fixation of the medium member 28. Both ends of the connection plate 38 are sunken for assembly of the first guide rollers 42, 42'. The connection plate 38 is fixed at the medium member 28 to rise or fall along with the operation of the piston 26. However, it may also be raised or dropped by a separate power source in relation to the operation of the sternal compression means 18.

Figure 4:
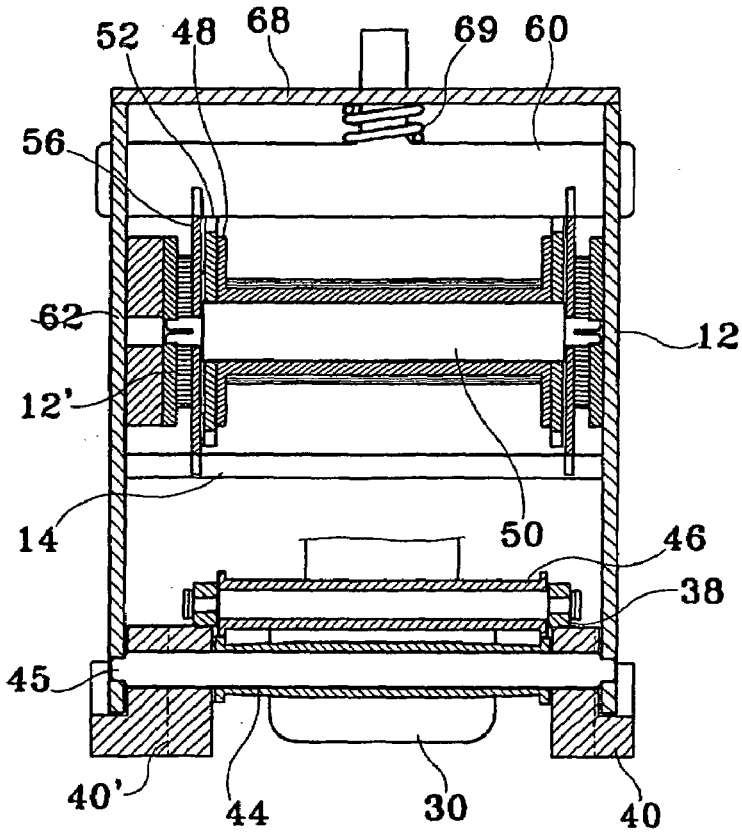
FIG. 4 is a cross-sectional view cut along arrow line II—II shown in FIG. 3.

As shown in FIGS. 3 and 4, the protection pads 40, 40' are fitted at both ends of an axle of the second guide rollers 44, 44' and fixed at the vertical lateral plates 12, 12'. The lower surfaces 40*a*, 40*a'* of the protection pads 40, 40' have curves having a predetermined degree of curvature. The protection pads 40, 40' are respectively attached to lower and upper sides of a patient's chest when the patient stands up. The upper protection pad 40' is wider than the lower protection pad 40. It is preferable that the protection pads 40, 40' are made of flexible material such as rubber, soft urethane or textile material.

The lower, external edges of the protection pads 40, 40' are bent for attachment of the vertical lateral plates 12; 12', while the internal sides of the protection pads 40, 40' are sunken for smooth rise and fall of both sides (front and back sides in FIG. 6) of the connection plate 38.

It is preferable that the chest band 20 is made of one of various materials such as woven fabric, non-woven cloth, leather and the like, and the width of the chest band 20 is about 10 cm. Then, the chest band 20 is wound around the bobbin of the length adjusting means 24, subsequently passed through the first guide roller 42, idle roller 46, second guide roller 44, second guide roller 44' and idle roller 46', and then is fixed at the first guide roller 42'. The chest band 20 is divided into two parts under the second guide roller 44' and connected by the hitching loops 20*a*, 20*b*. However, the chest band 20 may also be held at the first guide roller 42' for easy attachment and detachment.

As shown in FIGS. 2 through 4, the length adjusting means 24 is fastened above the idle roller 46 between the vertical lateral plates 12, 12'. The length adjusting means 24 comprises a bobbin 48 for getting the chest band 20 wound onto, a first ratchet wheel 52 inserted and fixed at an axle 50 of the bobbin 48, a first stopper 54 meshed with the first ratchet wheel 52 for preventing reverse rotation of the bobbin 48, a handle bracket 58 with the first stopper 54 coupled for guides and the second ratchet wheel 56 inserted at the axle of the bobbin 48 for free rotation, a second stopper 60 meshed to the second ratchet wheel 56 for restricting rotation of the handle bracket 58 and a spiral spring 62 for applying rotational force to the bobbin 48.

The first and second ratchet wheels 52, 56 and the spiral spring 62 are respectively fastened at both sides of the axle 50.

Figure 7:
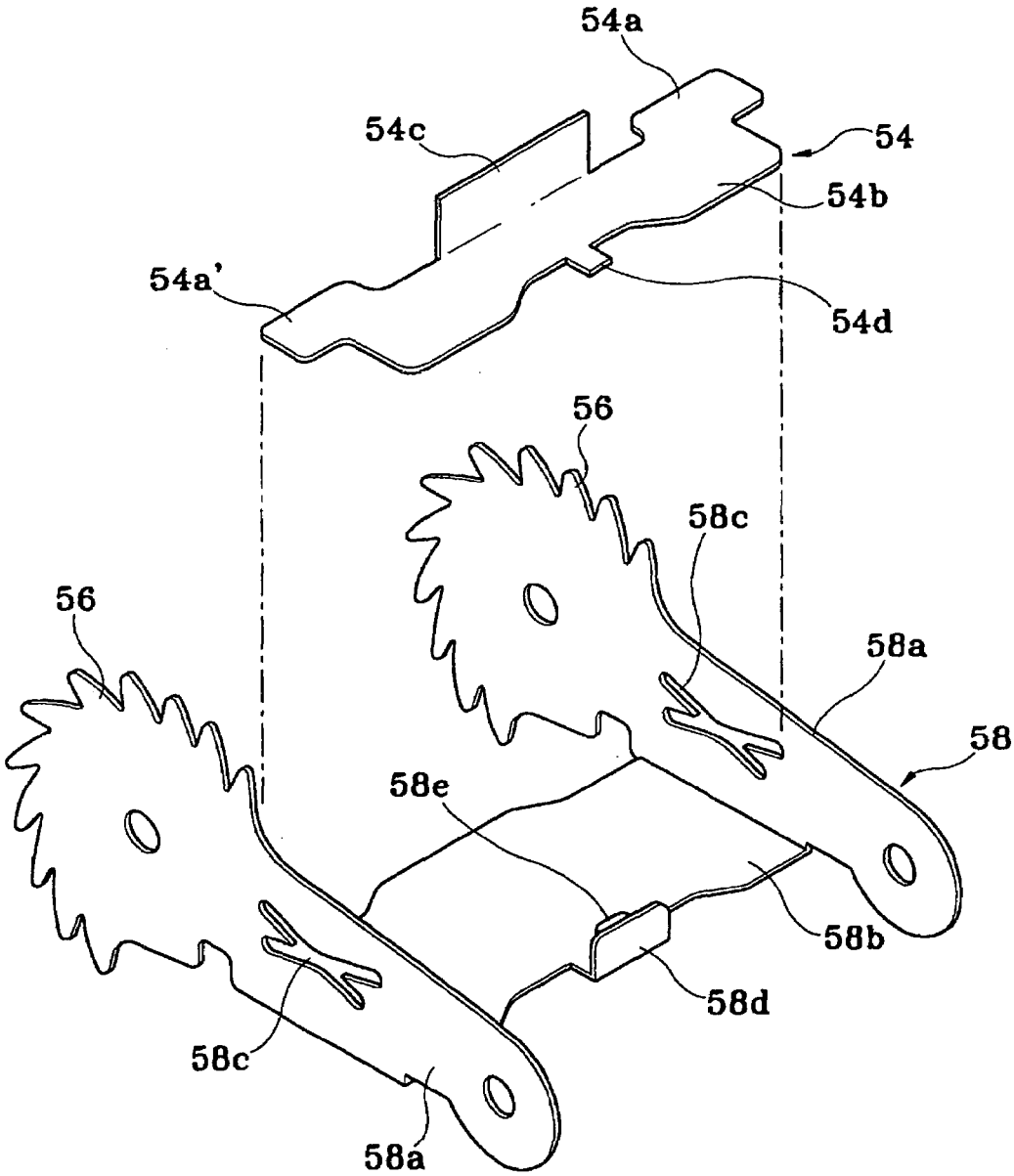
FIG. 7 is a perspective view for illustrating a first stopper and a handle bracket shown in FIG. 3.

As shown in FIG. 7, the first stopper 54 includes a horizontal plate 54*b* having wings 54*a*, 54*a'* to be inserted into guide slots of the handle bracket and a vertical flange 54*c* bent upward at one edge (wing side) of the horizontal plate 54*b* for being held by a hand and a hitching unit 54*d* horizontally protruded at the horizontal plate 54*b* opposite to the vertical flange 54*c* for insertion of a spring.

The handle bracket 58 is constructed with two ratchet plates 58*a* having second ratchet wheels 56 which are integrated by a connection plate 58*b*. The first ratchet wheel 52 is shaped in a circular plate and positioned at the internal side of the ratchet plate 58*a*.

The second ratchet wheel 56 having a serrate arc is positioned at one side of the ratchet plate 58*a*, and a guide slot 58*c* is formed at the center of the ratchet plate 58*a* for insertion of the wings 54*a*, 54*a'*. The guide slot 58*c* has the shape of a letter X which includes a first groove where the wing 54*a* is hitched by the saw tooth of the first ratchet wheel 52 and a second groove where the wing 54*a* is not hitched to the saw tooth of the first ratchet wheel 52. A cylindrical rod (64: shown in FIG. 2) is coupled opposite to the second ratchet wheel 56 for convenient handling by a user.

At the right, center of the connection plate 58*b* and at the upper portion of the bent flange 58*d*, a hitching unit 58*e* is protruded to face the hitching unit 54*d*. A spring (66: shown in FIG. 2) is inserted between the hitching units 54*d*, 58*e* for pushing the first stopper 54.

The second stopper 60 is vertically erected in the shape of a reverse T. The vertical lateral plates 12, 12' have slots for guiding both ends of the second stopper 60. An upper plate 68 is coupled at the upper sides of the vertical, lateral plates 12, 12'with slots that guide the upper center ends of the second stopper 60. A spring 69 is integrated between the second stopper 60 and the upper plate 68 for elasticity.

On the other hand, propping rods 70, 70' are inserted between the vertical lateral plates 12, 12' with a predetermined level of gap, for support and strength. Furthermore, a groove (12*a'*: shown in FIG. 5) is formed at the center of the vertical lateral plate 12 for preventing a stopper from being hitched in rotation.

Figure 5:
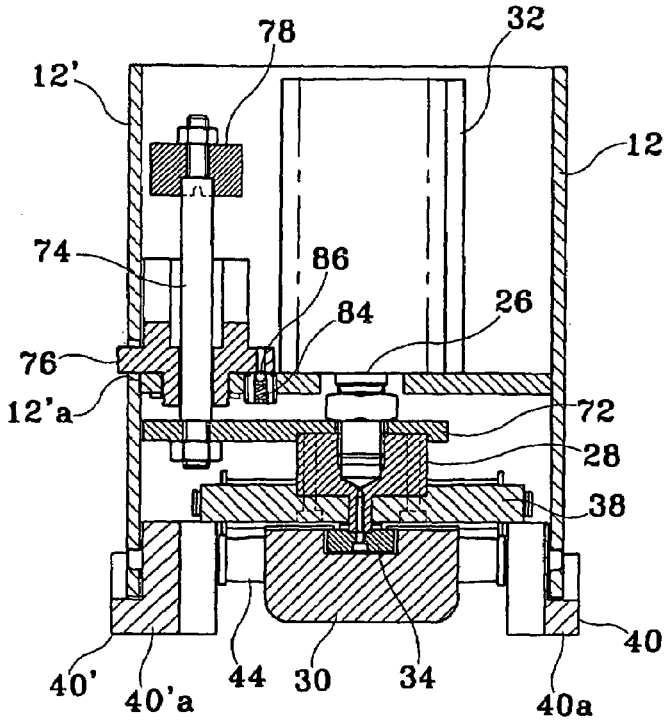
FIG. 5 is a cross-sectional view cut along arrow line III—III shown in FIG. 3.

As shown in FIG. 5, an axle member 74 is vertically fixed and coupled at an edge of a medium plate 72 fixed at the piston 26 of the compression means 18. In the horizontal center plate 14, a stopper 76 having a plurality of restricting grooves 80*a*, 80*b*, 80*c* (shown in FIG. 8) is rotatively inserted at the axle member 74. A restricting member 78 is inserted and fixed at the axle member 74 over the stopper 76 for being hitched at the restricting grooves 80*a*, 80*b*, 80*c* as the piston is lowered.

Figure 8:
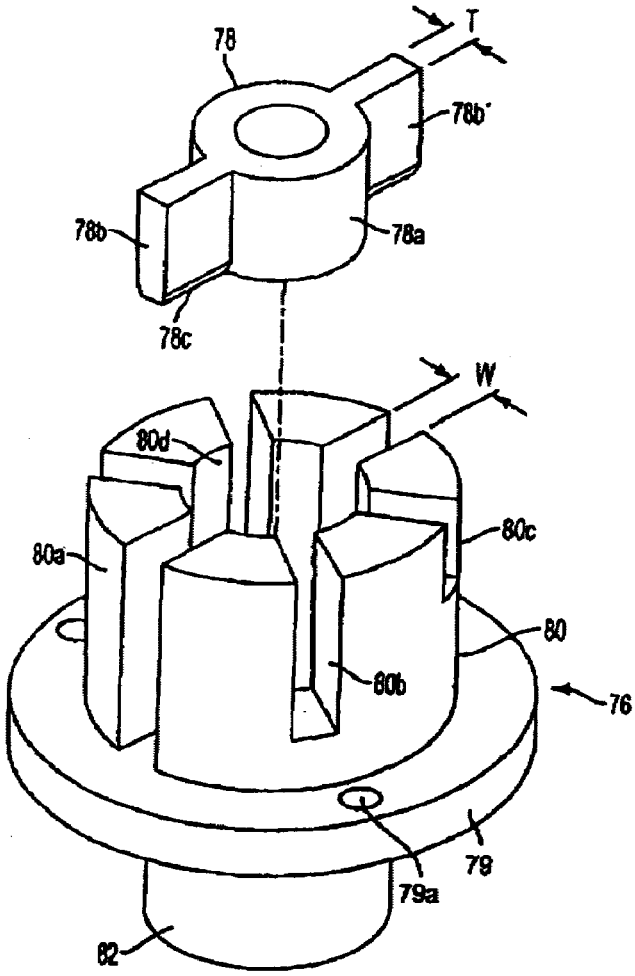
FIG. 8 is a perspective view for illustrating a stopper and a restricting member shown in FIG. 5.

As shown in FIG. 8, there is an accommodating unit 80 for accommodating the restricting member over a flange 79 formed in the middle of the stopper 76 and an insertion unit 82 for being inserted into the horizontal center plate 14 under the flange 79.

Grooves 79 are formed at the flange 79 for having balls hitched at the lower side thereof. A plurality of restricting grooves 80*a*, 80*b*, 80*c* are formed around the circumference of the stopper 76 with different levels of depth at the accommodating unit 80. Meanwhile, a center hole 80*d* is formed larger than the axle member 74 for insertion of the boss unit of the restricting member, which will be described below. The restricting grooves 80*a*, 80*b*, 80*c* and a hole 79*a* are spaced evenly apart at 120 degree angles. The respective grooves are formed symmetrically around the center hole 80*d* along the circumference of the stopper 76 at 60 degrees.

As shown in FIG. 8, the restricting member 78 includes a boss unit 78*a* for being inserted into the center hole 80*d* of the accommodating unit 80, and two flanges 78*b*, 78*b'* at the external surface of the boss unit 78*a* at 180 degrees for insertion into the restricting grooves 80*a*, 80*b*, 80*c*. The thickness of the flanges 78, 78' is smaller than the width of the restricting grooves 80*a*, 80*b*, 80*c*. A chamfer 78*c* is formed at the lower end of the flanges 78*b*, 78*b'* for smooth insertion.

On the other hand, a ball 86 is elastically supported by a spring 84 at the horizontal, center plate 14.

Hereinafter, the operation of the CPR apparatus thus constructed will be described in accordance with the first embodiment of the present invention.

One end of the chest band 20 is wound around the bobbin 48 of the length adjusting means 24, rolled around the first guide roller 42, the idle roller 46 and the second guide roller 44 and hitched with a hitching loop 20*a* at a hitching unit (not shown), and the other end of the chest band 20 is wound around the first guide roller 42', the idle roller 46' and the second guide roller 44' and hitched with a hitching loop 20*b* at the other hitching unit. Then the chest band 20 is kept at the state described above.

When the CPR apparatus is used, the horizontal flange unit 54*c* of the first stopper 54 is held and pulled back to move the wing 54*a* from the first groove to the second groove of the guide slot 58*c* to make the first ratchet wheel 52 free for rotation. Then the hitching loop 20*a* of the chest band 20 is pulled and wrapped around a patient's chest, and then the hitching loops 20*a*, 20*b* are connected. The wing 54*a* of the first stopper 54 is moved to the first groove of the guide slot 58*c* again and hitched at the saw tooth of the first ratchet wheel 52, and the second stopper 60 is hitched at the saw tooth of the second ratchet wheel 56. Therefore, the chest band 20 is adequately unwound to wrap around the patient's chest.

When a cylinder is operated by control means (not shown) to lower the piston 26, the compression pad 30 presses down the patient's chest and functions as a cardiac pump. At the same time, the connection plate 38 is lowered to fasten the chest band 20 wrapped around the patient's chest, thereby functioning as a thoracic pump. While the piston 26 is in operation, the first stopper 54 prevents the chest band 20 from being released from the bobbin 48, and the second stopper 60 prevents the handle bracket 58 from rotating and the chest band 20 from becoming loose.

On the other hand, when the piston 26 is in operation, it is necessary to control the height of the dropping compression pad 30. At this time, the stopper 76 rotates and stops by the ball 86 at a predetermined level of angle. Accordingly, one of the restricting grooves 80*a*, 80*b*, 80*c* is aligned at the flanges 78*b*, 78*b*' of the restricting member 78. When the piston 26 is lowered, the flanges 78*b*, 78*b*' are inserted into the restricting groove to restrict the dropping length of the piston.

The piston 26 is controlled by control means and a pneumatic circuit to keep the ratio of compression and relaxation at 50:50 and the compression speed at 80–100 times per minute according to the characteristics of the patient. The pneumatic circuit operates the piston 26. Oxygen is separately but simultaneously supplied to the patient's lungs. At this time, oxygen is subsequently supplied to the operation of the piston 26.

FIGS. 9 through 19 illustrate a cardiopulmonary resuscitation apparatus in accordance with the second embodiment of the present invention.

Figure 9:
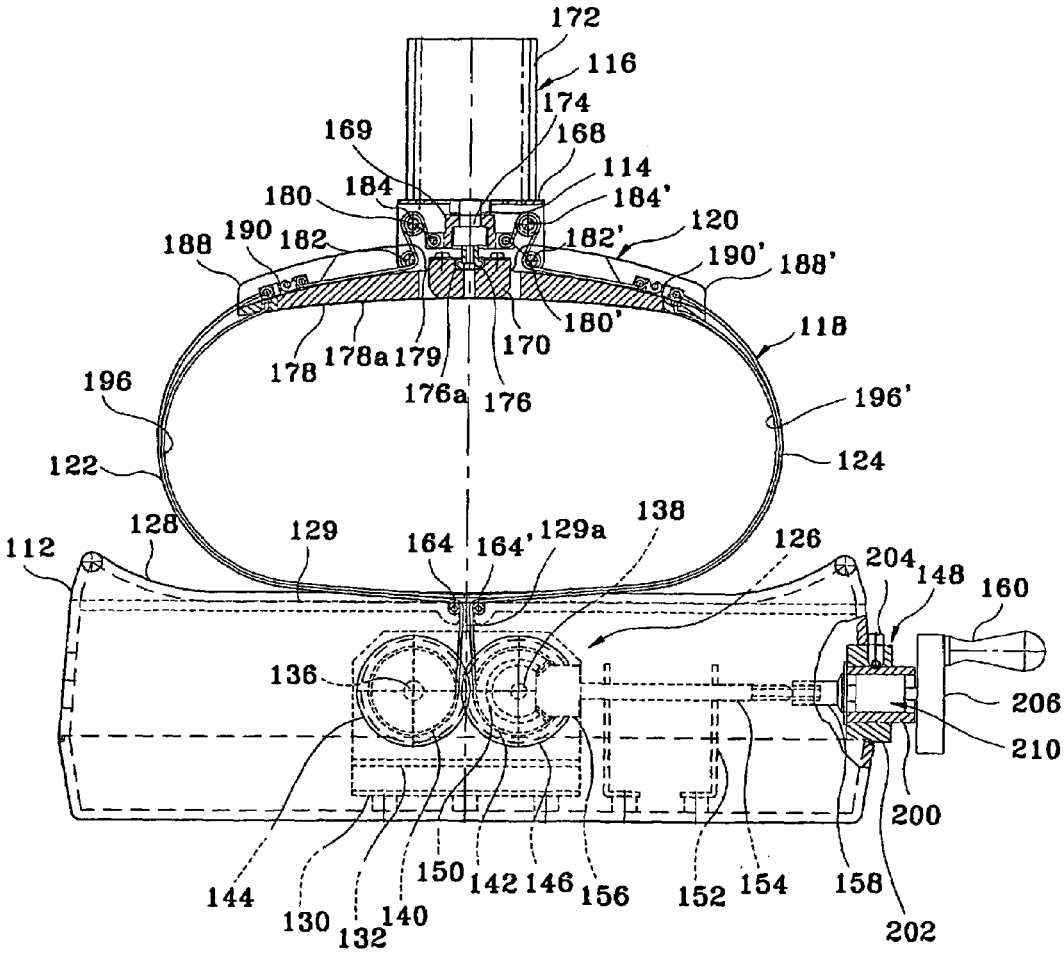
FIG. 9 is an elevation view for illustrating the cardiopulmonary resuscitation apparatus in accordance with the second embodiment of the present invention.
Figure 10:
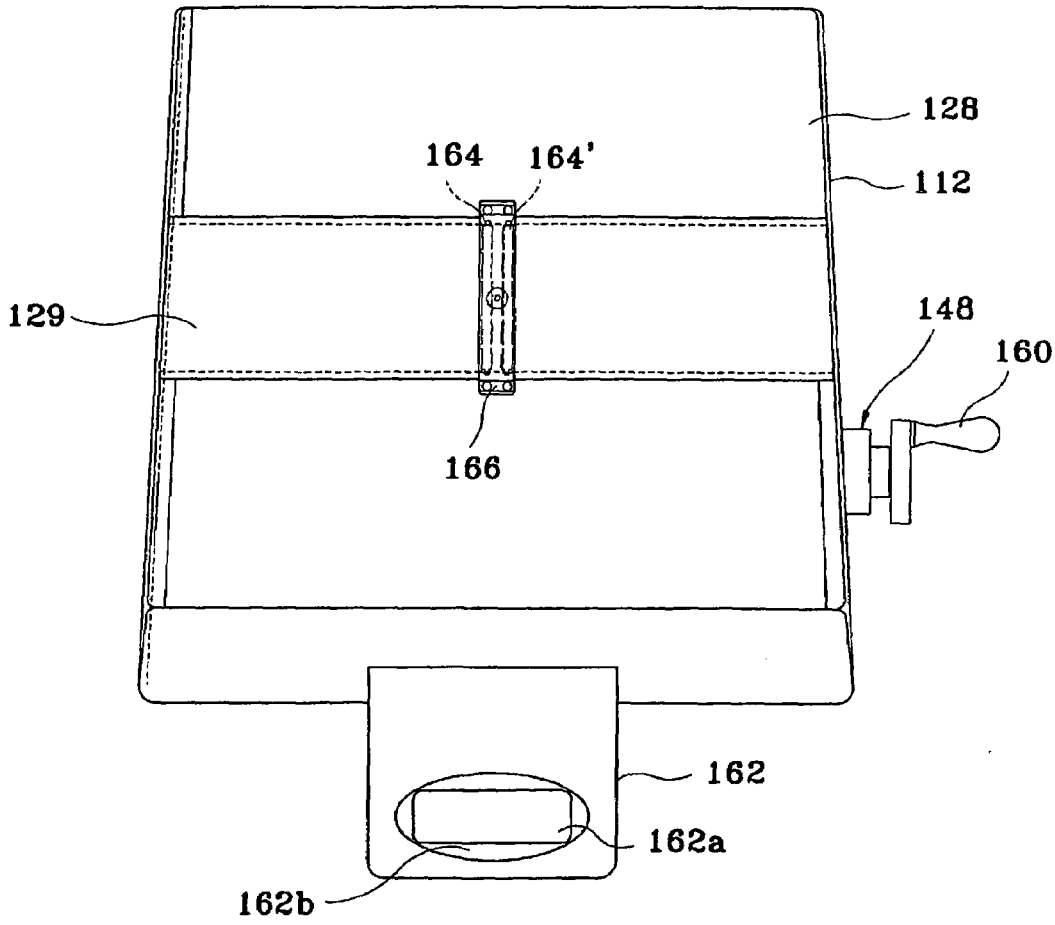
FIG. 10 is a plane of the main body shown in FIG. 9.
Figure 11:
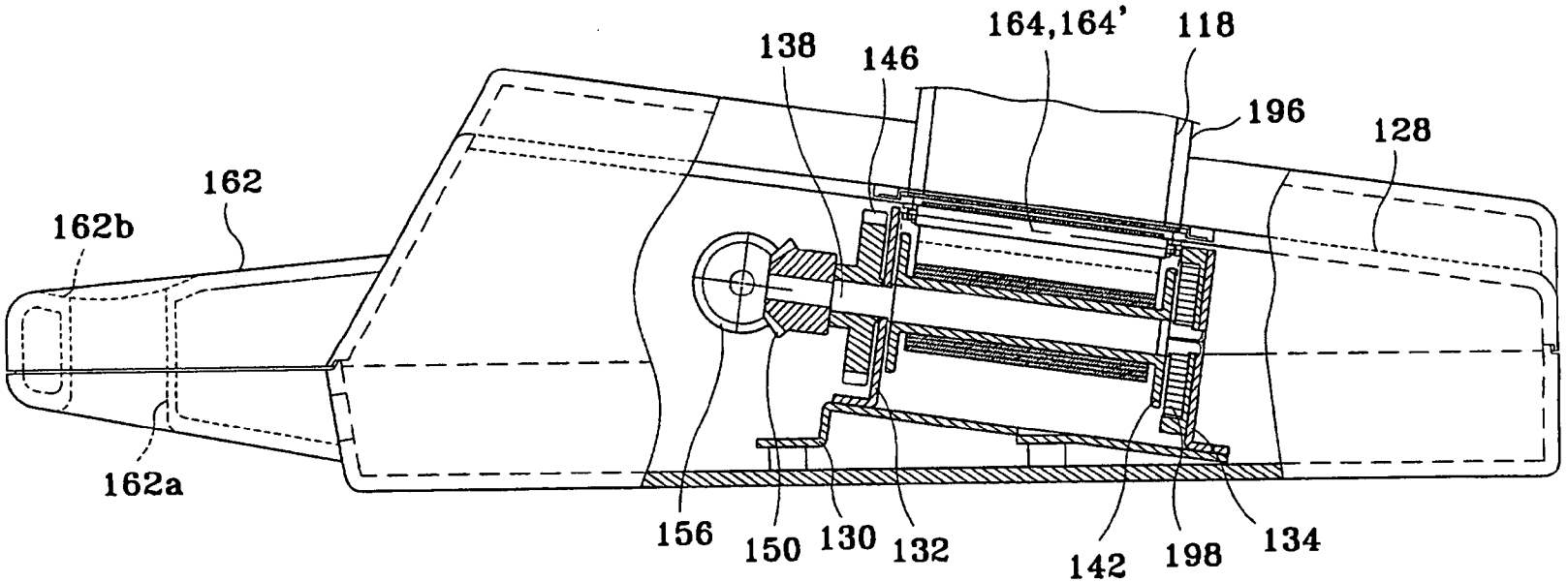
FIG. 11 is a lateral view of the main body shown in FIG. 9.

As shown in FIGS. 9 through 11, above a main body 112 where the patient lies, there are compression means 116 having a piston 114 that compresses the patient's chest and thoracic constriction means 120 having a chest band 118 for fastening and constricting the chest when the compression means 116 presses down the patient's chest.

The chest band 118 is divided into left and right chest bands 122, 124 for respectively wrapping around the left and right chests of a patient. Length adjusting means 126 is installed at the main body for controlling the length of the chest band 118 according to the size of the patient's chest.

The upper external surface of the main body 112 has protruded left and right sides and a support side 128 shaped with a lengthwise opening to hold around the patient when the patient is lying down. A lowered recess unit 129 is formed in the middle of a lengthwise support side 128 along the direction that the patient is lying down. The recess unit 129 is often horizontally formed with the same width as that of the chest band. The long hole 129*a* is formed in the middle of the recess unit 129, and the lower ends of the left and right chest bands 122, 124 are inserted into the main body 112 and wound onto the left and right bobbins.

The length adjusting means 126 includes a base bracket 130 at the internal side of the main body 112, propping brackets 132, 134, respectively at both sides of the base bracket 130 (left and right sides in FIG. 11) and left and right axle members 136, 138 between the prop brackets 132, 134. The left and right axle members 136, 138 further include left and right bobbins 140, 142 to get the left and right chest bands 122, 124 wound around, electric gears 144, 146 made of spur gears meshing each other. An electric gear 150 made of a bevel gear is mounted at an end of the right axle member 138 to be driven by driving means 148.

Furthermore, the driving means 148 includes a driving axle 154 via propping bracket 152 at the internal side of the main body 112. A driving gear 156, a bevel gear meshed to the electric gear 150 is fixed at one end of the driving axle 154, and a spline is fastened at the other end of the driving axle 154 for attachment and detachment of a handle axle 158. A handle 160 is fixed at the handle axle 158.

At this time, the driving means may be constructed with a driving gear meshed to the electric gear for rotation, a driving axle fastened to the driving gear and a motor to be controlled by the control means for rotation of the driving axle.

A head support unit 162 is protruded at the front side of the main body 112 for supporting a patient's head, and a hole 162*a* is formed at the head support unit 162 for convenient handling by a user. A curve surface 162*b* is formed over the hole 162*a* for the easy support of the patient's head. The head support unit 162 is positioned lower than the support side 128. Furthermore, guide rollers 164, 164' are coupled around the long hole 129*a* for guiding the left and right chest bands 122, 124 and are covered by a protection cover 166, both sides of which are fixed at the support side 128.

Figure 12:
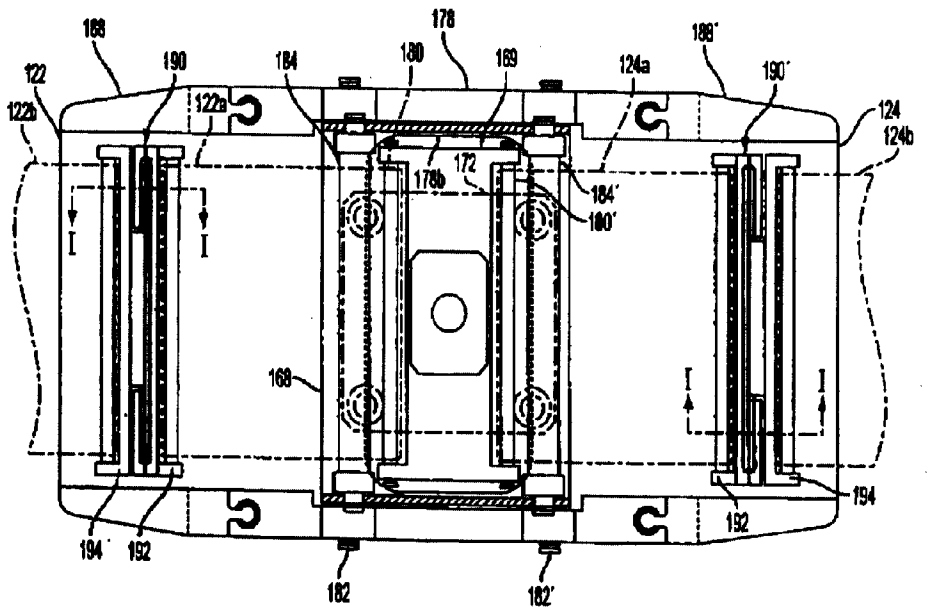
FIG. 12 is a plane for illustrating the sternal compression means and thoracic constriction means shown in FIG. 9.
Figure 14:
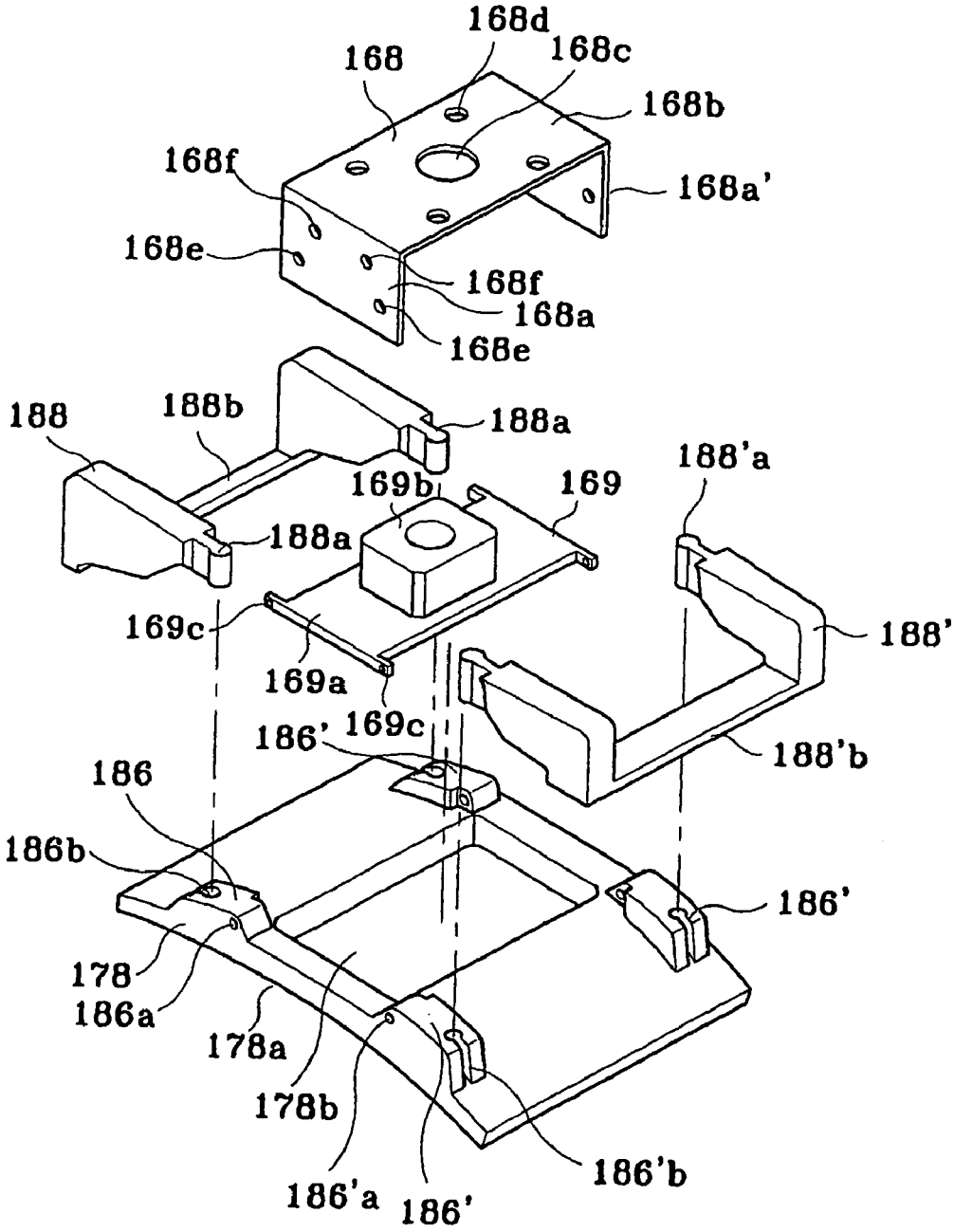
FIG. 14 is an analytical perspective view for illustrating the parts shown in FIG. 12.

As shown in FIGS. 9, 12, 14, in the compression means 116, a compression pad 170 is installed at the piston 114 protruded down from the support bracket 168 via a connection bracket 169. The piston 114 is embedded at the cylinder 172 and operated by air pressure. The compression pad 170 may be directly coupled with the piston 114.

The support bracket 168 is fixed at a frame (not shown) and shaped in the cross-section of having bent flanges 168*a*, 1689*a*' at both sides as shown in FIG. 14. A hole 168*c* and a cylinder fixing hole 168*d* are fixed at the upper surface of the wave 168*b* for passage of the piston 114. A plurality of holes 168*e*, 168*f* are formed at the flanges 168*a*, 168*a*' for insertion of the axles of the guide and idle rollers.

The piston 114 is constructed in the same structure as that of the first embodiment of the present invention. The cylinder 172 is fixed on the support bracket 168.

The connection bracket 169 is fixed at the cross-section of the piston 114 by a bolt 174, and a hitching block 176 which will be inserted and hitched to the compression pad 170 is fixed on the lower surface of the connection bracket 169.

The thoracic constriction means 120 includes the connection bracket 169, a plurality of rollers at both sides of the support brackets 168 for guiding the chest band 118 to wrap around the patient's chest and a protection pad 178 to be attached to the chest as the chest band 118 is fastened.

The rollers guiding the chest band 118 includes fixation rollers 180, 180' fastened at both sides of the connection bracket 169 for fixation of the left and right chest bands 122, 124, guide rollers 182, 182' fastened at both lower sides of the support bracket 168 for guiding the left and right chest bands 182, 182' and simultaneously fastening the protection pad and idle rollers 184, 184' mounted between the guide and fixation rollers 182, 182', 180, 180'.

As shown in FIG. 14, the connection bracket 169 includes a protruder 169*b* protruded at the center of the base plate 169*a* and holes 169*c* formed at both sides of the base plate 169*a* for insertion of an axle that fastens a fixation roller 180 accommodated at a carved portion made for fixation of the fixation rollers 180, 180'. At this time, a hole is formed at the protruder 169*b* for insertion of the bolt 174. The connection bracket 169 is fixed at the piston 114 to be raised or dropped by the motion of the piston 126. However, the connection bracket 169 may be constructed to move up or down in relation to the compression means 118 with a separate power source.

As shown in FIG. 14, the protection pad 178 includes a curved bottom surface 178*a* having a predetermined degree of curvature around a patient's chest and a rectangular hole 178*b* in the middle for passage of the connection bracket 169 and compression pad 170, four protruders 186, 186' protruding out of the rectangular hole. In addition, auxiliary pads 188, 188' are respectively inserted into the protruders 186, 186'.

Furthermore, holes 186*a*, 186*a'* are formed at one side of the protruders 186, 186' for inserting the axle of the guide rollers 182, 182', and hitching grooves are formed at the other side of the protruders 186, 186' for insertion of the hitching protruders 188*a*, 188*a'* of the auxiliary pads 188, 188'.

The auxiliary pads 188, 188' are extended from the hitching protruders 188*a*, 188*a'* in the lengthwise direction of the protection pad 178, and both of the extended ends are connected to the connection units 188*b*, 188*b'*. The lower surface of the connection parts 188*b*, 188*b'* is made of a curve connected with the bottom surface 178*a* of the protraction pad.

It is preferable that the protection pad 178 and auxiliary pads 188, 188' are made of rubber, soft urethane or the like.

Figure 13:
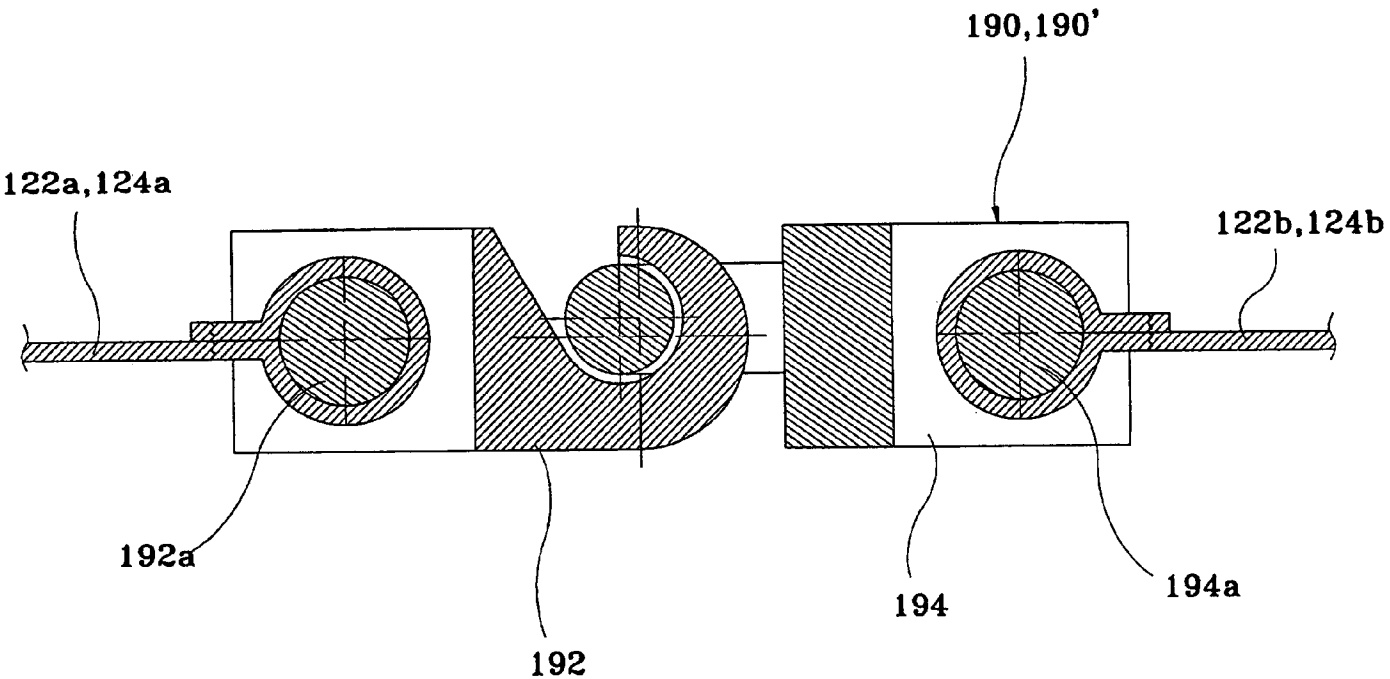
FIG. 13 is a cross-sectional view of the attachable and detachable connection unit shown in FIG. 2 as seen along arrow line A—A.

On the other hand, as shown in FIGS. 12 and 13, the left and right chest bands 122, 124 are divided into fixed chest bands 122*a*, 124*a*, and flexible chest bands 122*b*, 124*b* by the connection units 190, 190' over the auxiliary is pads 188, 188' for attachment and detachment. In the connection units 190, 190' one side of the female and male connection units 192, 194 are hinged, and rods 192*a*, 194*a* are formed at the other side of the female and male connection units 192, 194 for fixation of the fixed chest bands 122*a*, 124*a* and the flexible chest bands 122*b*, 124*b*.

The material and width of the chest band 118 are the same as those described in the first embodiment of the present invention. The fixed chest bands 122*a*, 124*a* are fixed at the fixation rollers 180, 180', passed through idle rollers 184, 184' and guide rollers 182, 182', and finally fixed at the rod 192. The flexible chest bands 122*b*, 124*b* are fixed at the rod 194*a*, passed through guide rollers 164, 164' coupled with the main body 112 and through the long hole 129*a* and finally wound onto the left and right bobbins.

As shown in FIG. 9, skin protection bands 196, 196' having elasticity are coupled at the internal surface of the chest band 118 (only the exposed portion of the main body) for protecting the patient's skin. The skin protection bands 196, 196' are fixed at the lower surface of the connection units 188*b*, 188*b'* of the auxiliary pads 188, 188' and connected to the lower side of the protection cover 166 surrounding the guide rollers 164, 164' coupled with the main body 112 for wrapping around the patient's body. The skin protection bands 196, 196' are elastically fastened or relaxed for keeping it tightly attached to the body at all times.

In addition, a spiral spring 198 is included in the left and right axle members 136, 138 of the length adjusting means 126 for providing the recovering force to the left and right bobbins 140, 142.

Furthermore, a handle axle 158 of the driving means 148 is fastened to a housing via a ring-shaped slider 200 that moves only along the axle. The housing 202 is fixed at the lateral wall of the main body 112. The slider 200 and housing 202 are coupled by well-known stopping means 204 consisting of a ball, a spring and a set screw for stopping the left and right direction of the slider 200. The locking means 210 is fastened at the handle axle 158 for preventing rotation of the handle.

Figure 15:
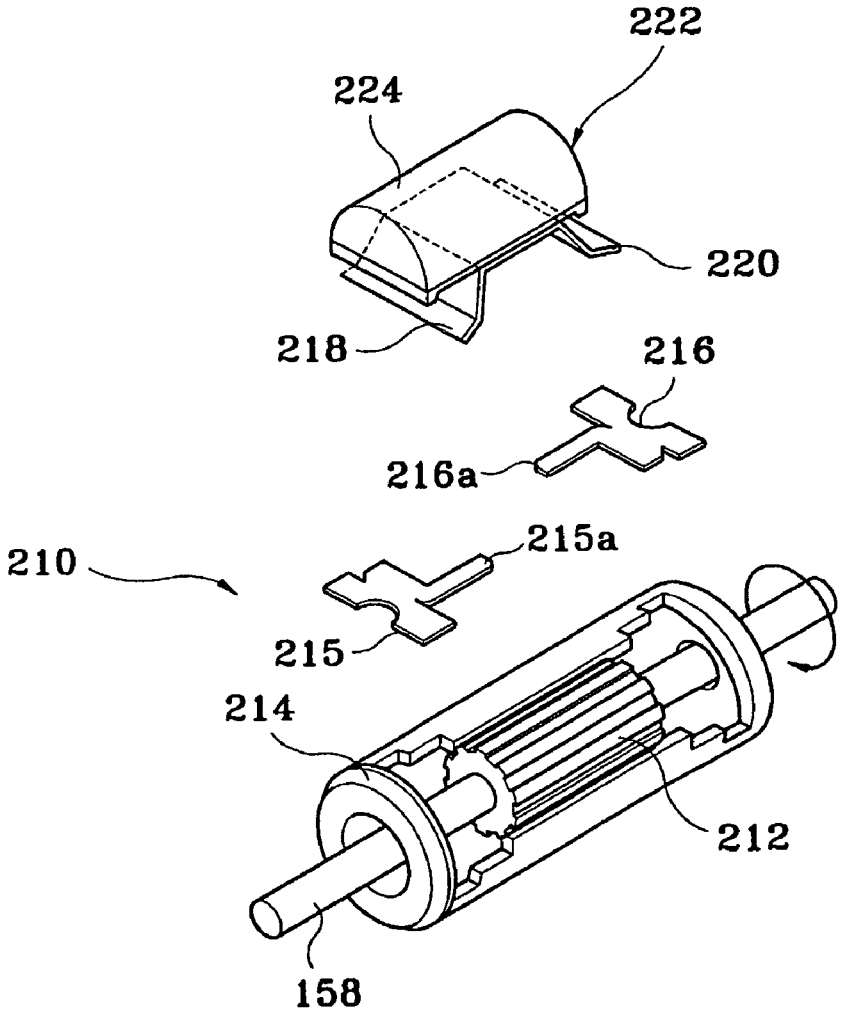
FIG. 15 is an analytical, perspective view for illustrating the locking means of the cardiopulmonary resuscitation apparatus in accordance with the second embodiment of the present invention.
Figure 16:
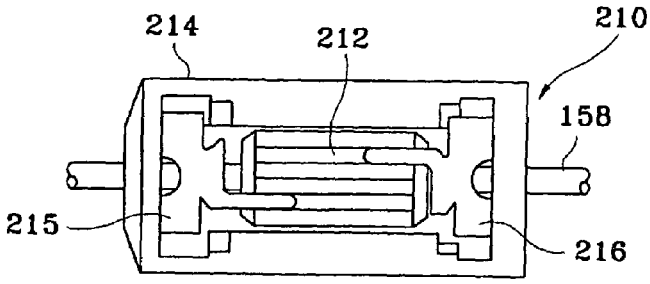
FIG. 16 is an assembling plane view of the locking means shown in FIG. 15.

On the other hand, as shown in FIGS. 15, 16, the locking means 210 includes a gear 212 fixed at the handle axle 158, an internal housing 214 installed at the external side of the handle axle 158 for accommodating the gear 212, left and right stoppers 215, 216 having protruders 215*a*, 216*a* on the both sides of the gear 212 for being hitched with the tooth of the gear and a switch 222 fastened over the left and right stoppers 215, 216 with left and right spring plates 218, 220 that selectively press the stoppers 215, 216.

One side of the internal housing 214 is left open for installation of the left and right stoppers 215, 216 and the switch 222 while a hitching jaw is included for hitching the left and right stoppers 215, 216. The switch 222 is constructed with the left and right spring plates 218, 220 under a knob 224.

Hereinafter, the operation of the cardiopulmonary resuscitation apparatus constructed by the second embodiment of the present invention will be described below.

First, the female connection unit 192 is separated from the male connection unit 194 of the connection units 190, 190' for taking the flexible chest bands 122*b*, 124*b* off from the fixed chest bands 122*a*, 124*a*. At this time, if there are no skin protection bands 196, 196' in the structure, the male connection unit 194 may be simply separated from the female connection unit 192.

Figure 19:
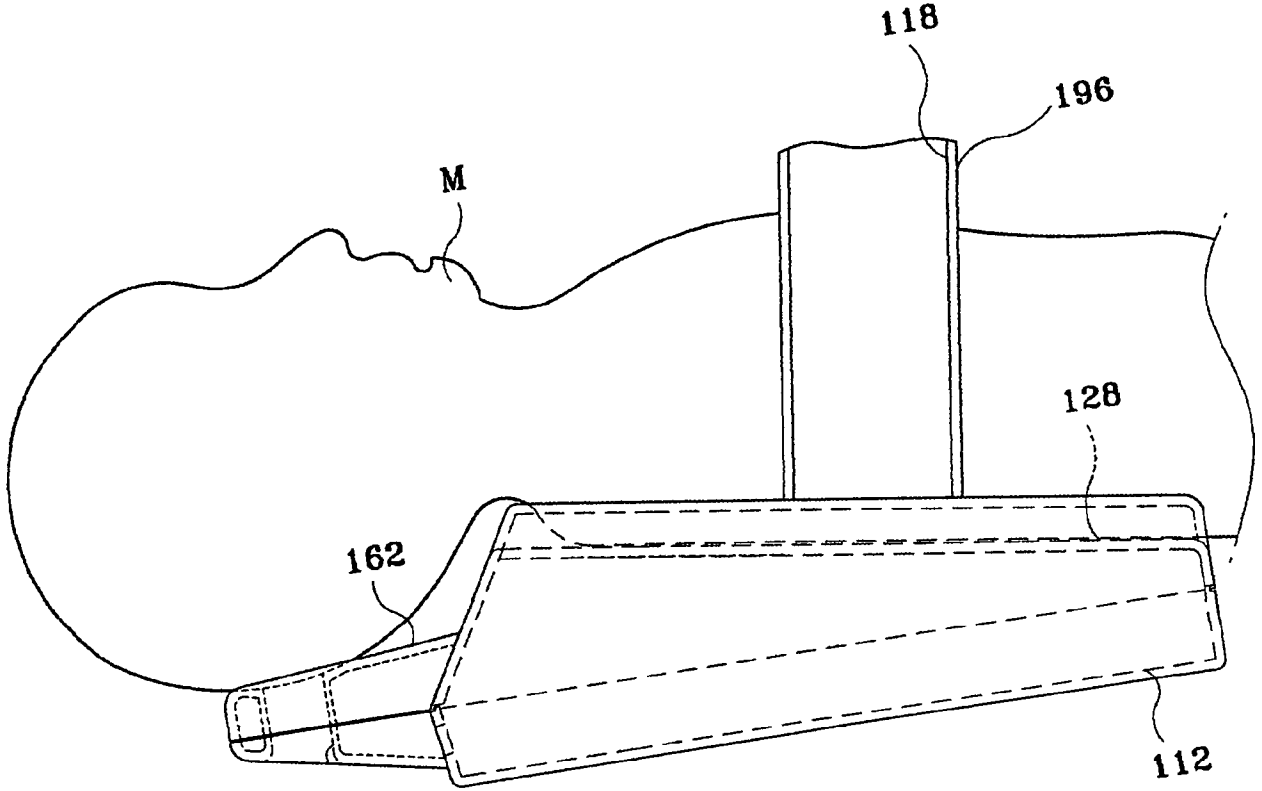
FIG. 19 illustrates a patient lying on the cardiopulmonary resuscitation apparatus of the present invention.

In the state described above, a patient M lays on the support side 128 of the main body 112 on the back with his head supported by the head support unit 162. Then, in reverse sequence to the aforementioned separation steps, the flexible chest bands 122*b*, 124*b* are connected to the fixed chest bands 122*a*, 124*a* and the auxiliary pads 188, 188' to the protection pad 178. At this time, the flexible chest bands 122*b*, 124*b* are released properly from the left and right bobbins 140, 142 after overcoming the recovering force of the spiral spring 198, to wrap around the patient's chest. FIG. 19 illustrates a patient (M) lying on the CPR apparatus with his chest wrapped by the chest bands.

Next, if the handle 160 is pushed to move the slider 200, spline-fasten the handle axle 158 to the driving axle 154 and fix the handle axle 158 with the locking means 210, the left and right bobbins 140, 142 do not rotate due to the fixation of the length of the released chest bands. The stopping means 204 prevents the handle axle 158 from being separated from the driving axle 154.

Figure 17:
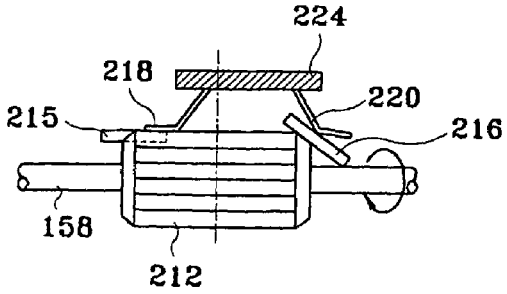
FIGS. 17 and 18 illustrate operational states of the locking means shown in FIG. 15.

When the knob 224 of the locking means 210 is moved to the right as shown in FIG. 17, a right spring plate 220 presses down the right stopper 216 to release the protruder 216*a* of the right stopper 216 from the teeth of the gear 212 and keep the protruder 215*a* of the left stopper 215 from being hitched at the teeth of the gear 212, thereby causing the left stopper 215 to be hitched at the housing 214 and restrict counterclockwise (CCW) rotation of the handle.

Figure 18:
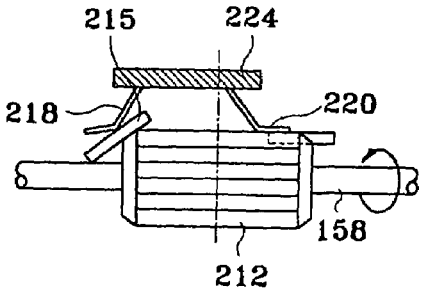

Furthermore, when the handle 224 of the locking means 210 is moved to the left as shown in FIG. 18, the left spring plate 218 presses the left stopper 215 to release the protruder 215*a* of a left stopper 215 from the teeth of the gear 212 and keep the protruder 216*a* of the right stopper 216 hitched at the teeth of the gear 212, thereby causing the right stopper 216 to be hitched at the housing 214 and restrict clockwise (CW) rotation of the handle.

When the cylinder 172 is operated by control means (not shown) to lower the piston 114, the compression pad 170 presses down the patient's chest to function as a cardiac pump. At the same time, the connection bracket 169 descends to allow the chest band 118 wrapped around the patient's chest to fasten and function as a thoracic pump. At this time, the protection pad 178 and auxiliary pads 188, 188' are tightly attached to the chest for protection of the patient's chest, and the skin protection bands 196, 196' are attached to the patient's body with elasticity.

Meanwhile, when the chest band 118 is initially wound onto the left and right bobbins 140, 142, and when the locking means 210 is released for rotation of the handle 160, the left and right bobbins 140, 142 are rotated by the driving and electric gears to wind the chest band 118.

The operation of the piston 114 in the CPR apparatus thus constructed is described for the first embodiment of the present invention.

FIGS. 20 through 25 illustrate a cardiopulmonary resuscitation apparatus constructed in accordance with the third embodiment of the present invention.

Figure 20:
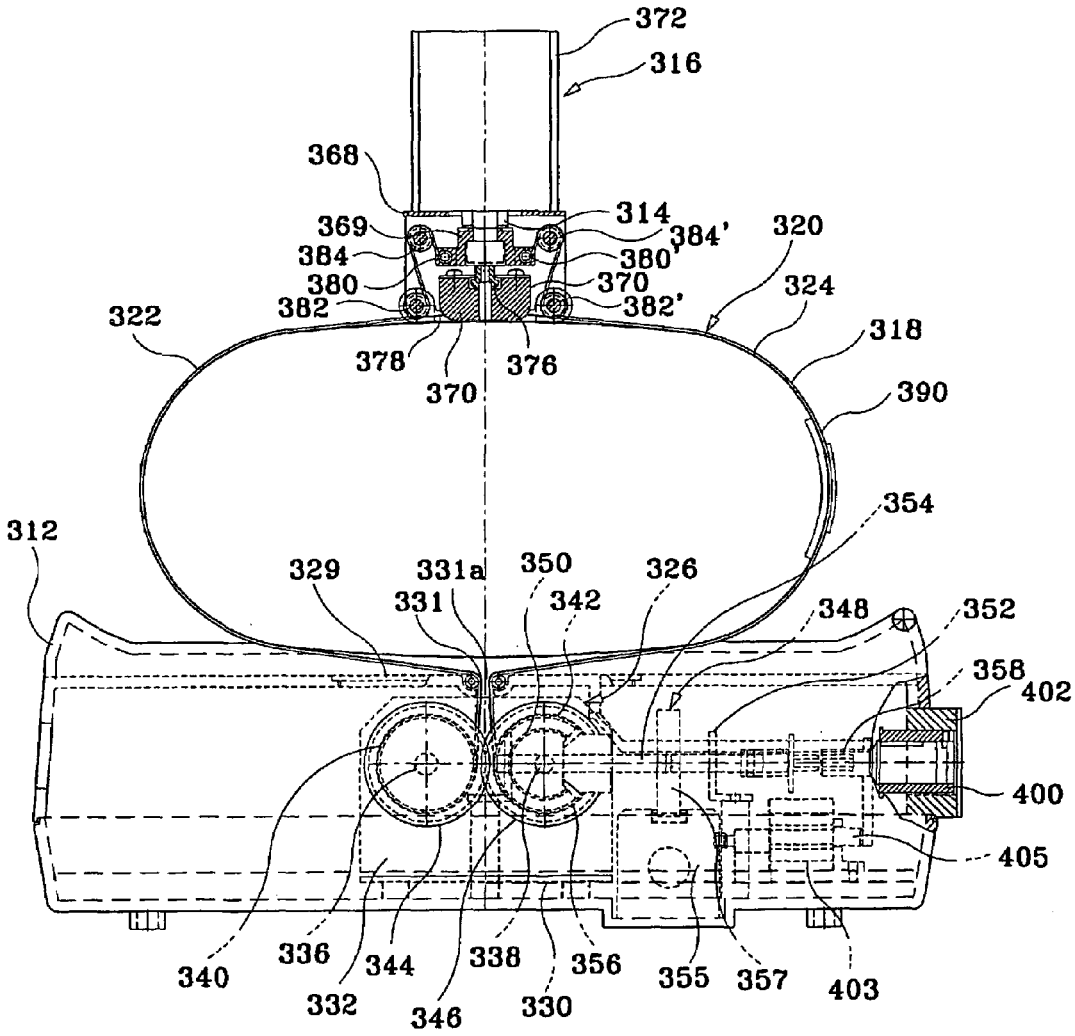
FIG. 20 illustrates an elevation view for illustrating the cardiopulmonary resuscitation apparatus in accordance with the third embodiment of the present invention.
Figure 21:
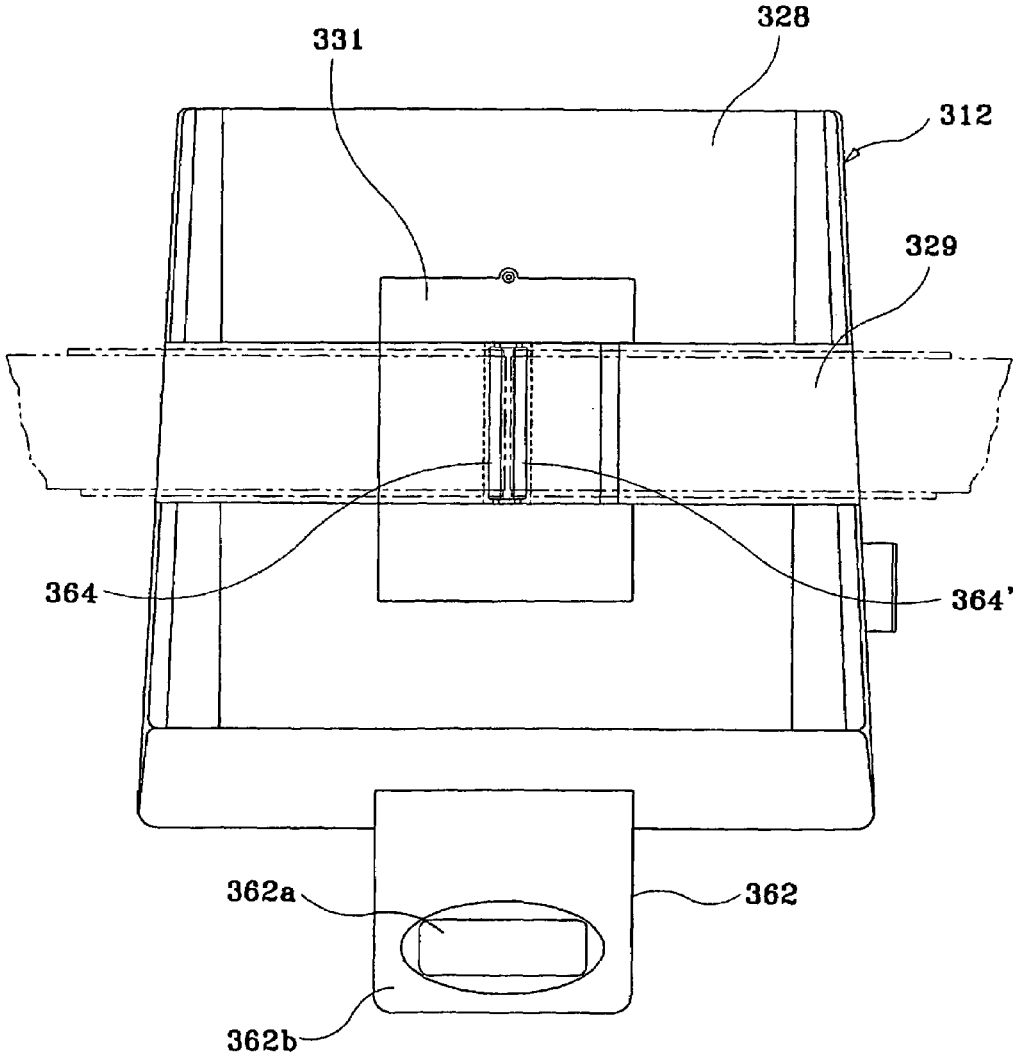
FIG. 21 is a plane view of the main body shown in FIG. 20.
Figure 22:
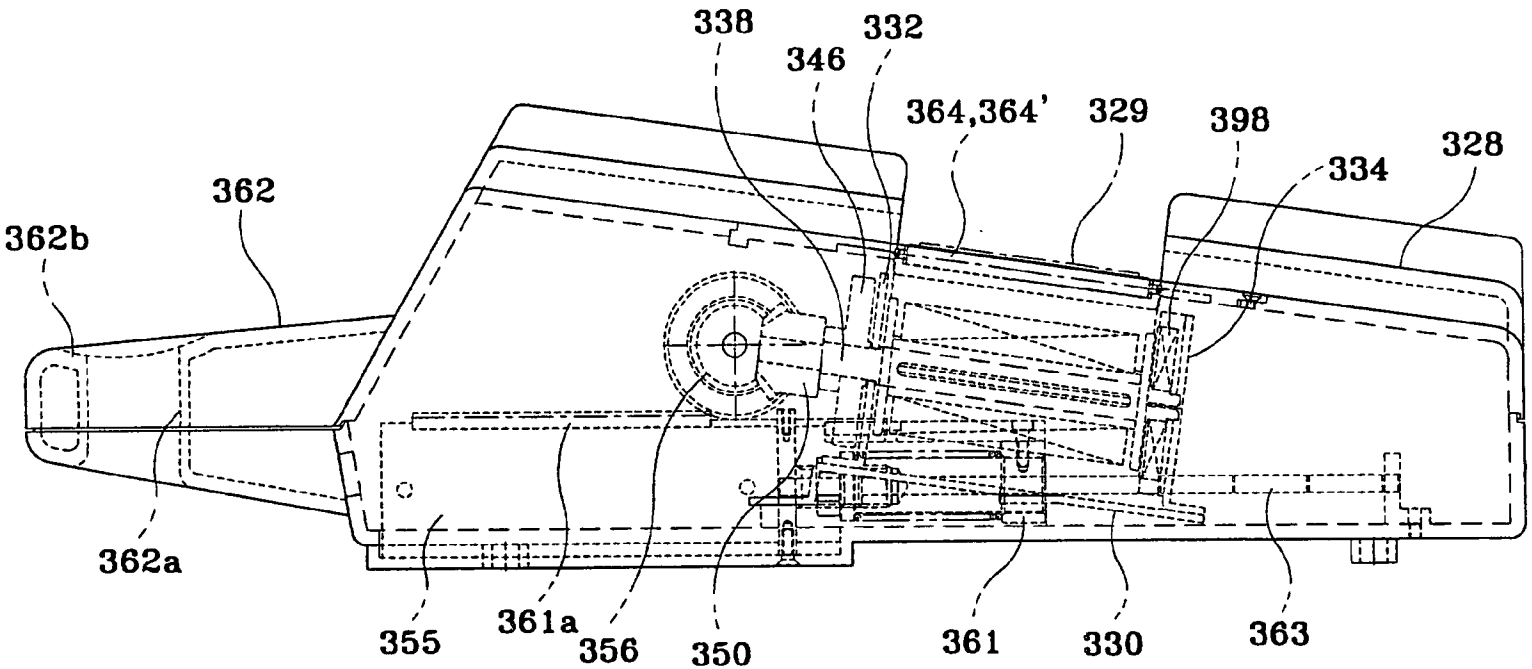
FIG. 22 is a lateral view of the main body shown in FIG. 20.

As shown in FIGS. 20 through 22, there is compression means 316 having a piston 314 that compresses down on a patient's chest when the patient is lying down, and chest constriction means 320 having a chest band 318 that fastens and constricts the chest, when the compression means 316 presses down the chest, above the main body 312.

At this time, the chest band 318 is divided into left and right chest bands 322, 324 for respectively winding around left and right sides of the patient with length adjusting means 326 installed at the main body for adjusting the length of the chest band 318.

The main body 312 has left and right protruders and remains open in the lengthwise direction of the support side for wrapping around a patient when the patient is lying in a flat, horizontal position. The support side 328 also has a recess 329 in the middle portion of the lengthwise direction. The width of the recess 329 is identical to the width of the chest band. A cover 331 is formed at the center of the recess 329 with a long hole 331*a*. The lower ends of the left and right chest bands 322, 324 are inserted through the long hole 331*a* into the inside of the main body 312 and then wound onto the left and right bobbins.

The length adjusting means 326 includes a base bracket 330 installed at the internal part of the main body 312, support brackets 332, 324 at both sides of the base bracket 330 (at the left and right sides in FIG. 22), left and right axle members 336, 338 between the support brackets 332, 334, left and right bobbins 340, 432 where the left and right chest bands 322, 324 are wound, electric gears 344, 346 made of spur gears for being meshed together, and an electric gear made of a bevel gear at the end of the right axle member 338 for being driven by the driving means 348.

The driving means 348 includes a driving axle 354 installed at the internal side of the main body 312 via a support bracket 352, a center gear 356, a bevel gear fixed at one end of the driving axle 354 for being meshed to the electric gear 350, locking means spline-fastened at the other end of the driving axle 354 for attachment and detachment, a driving gear 357 inserted at the center of the driving axle 354 for being driven by the driving cylinder 355 and a moving member 361 formed at the piston of the driving cylinder 355 with a rack gear 361*a* for being meshed to the driving gear 357. The moving member 361 is included to be guided by the guide rod 363, fixed at the end of the piston and bent and extended toward the cylinder with a rack gear 361*a* at an extended part.

A head supporter 362 protrudes at the front portion of the main body 312 for supporting the patient's head. The hole 362*a* and curved surface 362*b* are shaped in the same way as the second embodiment of the present invention.

Guide rollers 364, 364' are coupled at the place where the long hole 331*a* of the cover 331 is formed for guiding the left and right chest bands 322, 324.

Figure 23:
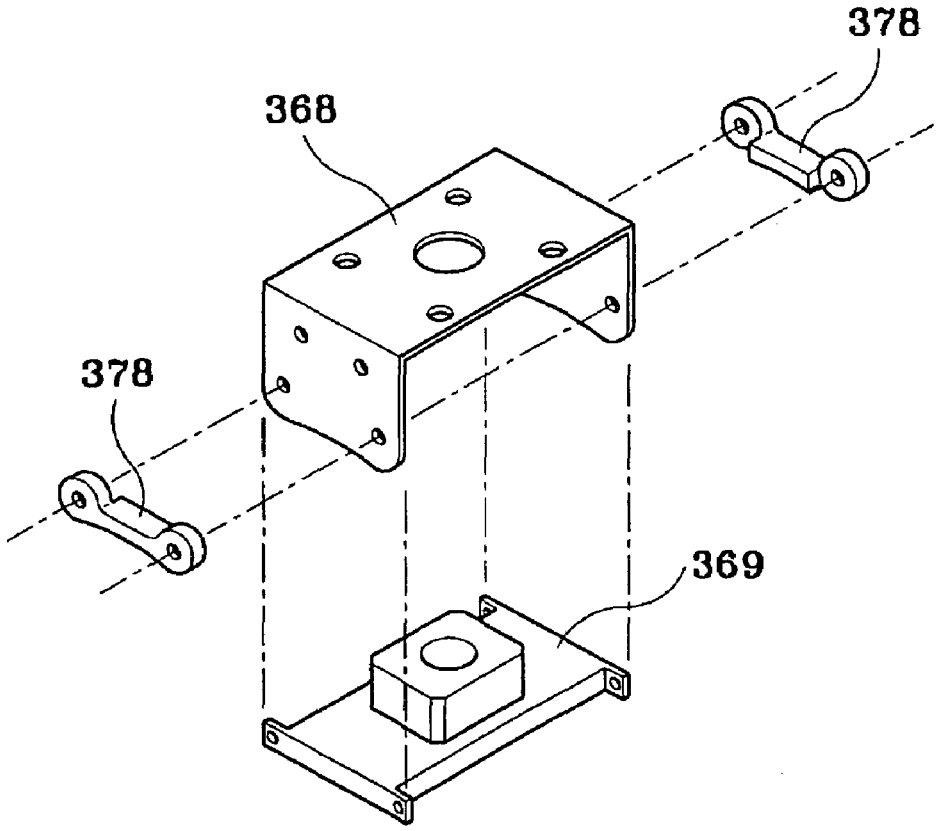
FIG. 23 is an analytical, perspective view for illustrating the parts of the sternal compression means and thoracic constriction means shown in FIG. 20.

As shown in FIGS. 20 and 23, the compression means 316 has a compression pad 370 fastened at the piston 314 protruding downward from a support bracket 368 via a connection bracket 369. The piston 314 is embedded in the cylinder 372 and operated by pressurized air or oxygen. The compression pad 370 is directly coupled with the piston 314. The piston 314, support bracket 368, connection bracket 369, compression pad 370, cylinder 372 and hitching block 376 are the same as those in the second embodiment of the present invention.

The chest constriction means 320 includes a plurality of rollers at both sides of the connection bracket 369 and support bracket 368 for getting the chest band 318 wound around the patient's chest and pads 378, 378' for being attached to the patient's chest when the chest band 318 is fastened. The fixed rollers 380, 380', idle rollers 384, 384' and guide rollers 382, 382' are constructed in the same way as those constructed in the second embodiment of the present invention.

It is preferable that the pad 378 is fastened at the external portion of both ends of the flange of the support bracket 368 by the guide rollers 382, 382' with a curved lower surface having a predetermined curvature in the direction of the patient's chest. It is also preferable that the pad 378 is made of rubber, soft urethane or the like.

Figure 24:
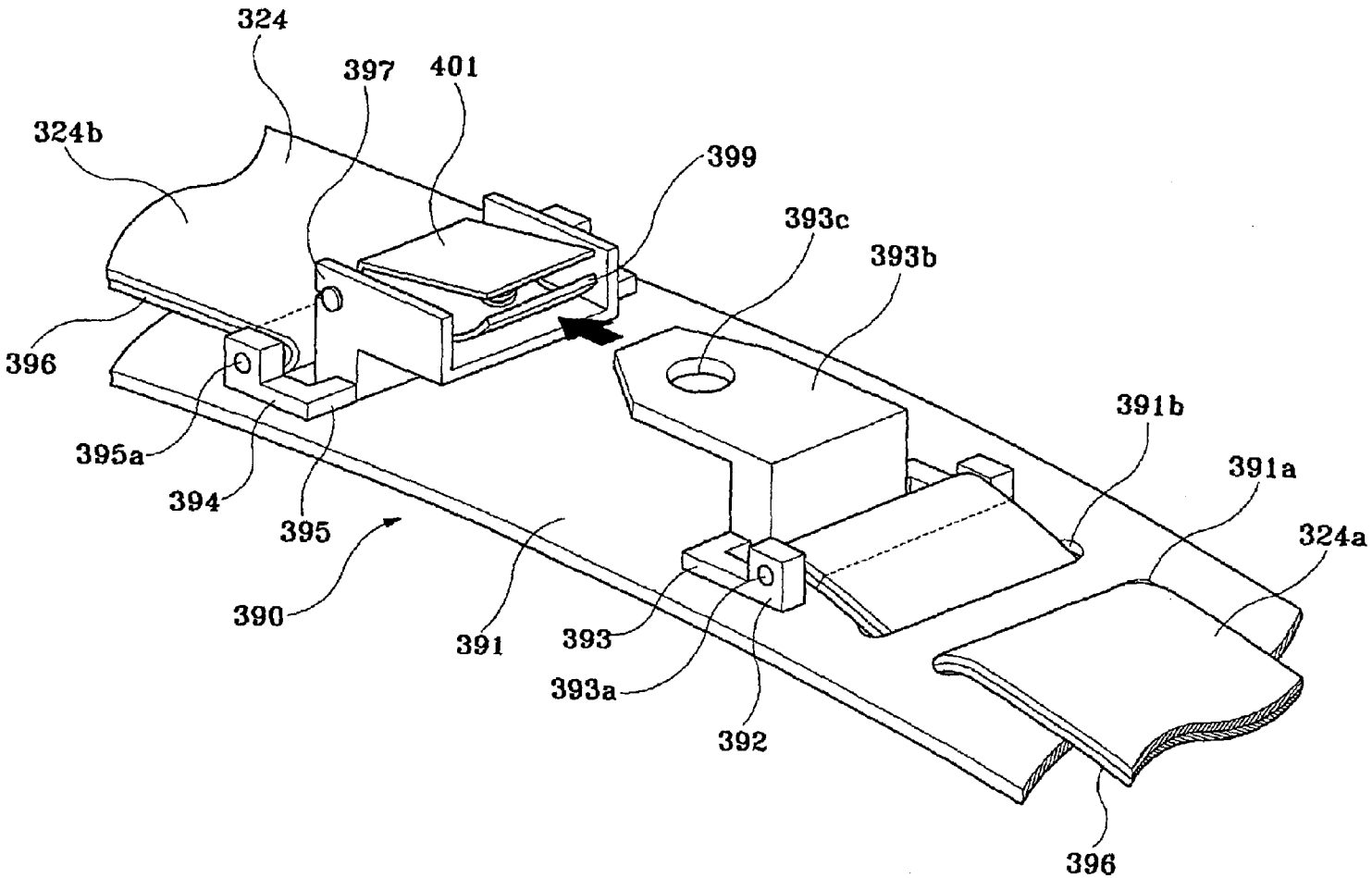
FIG. 24 is a perspective view for illustrating the connection unit shown in FIG. 20.
Figure 25:
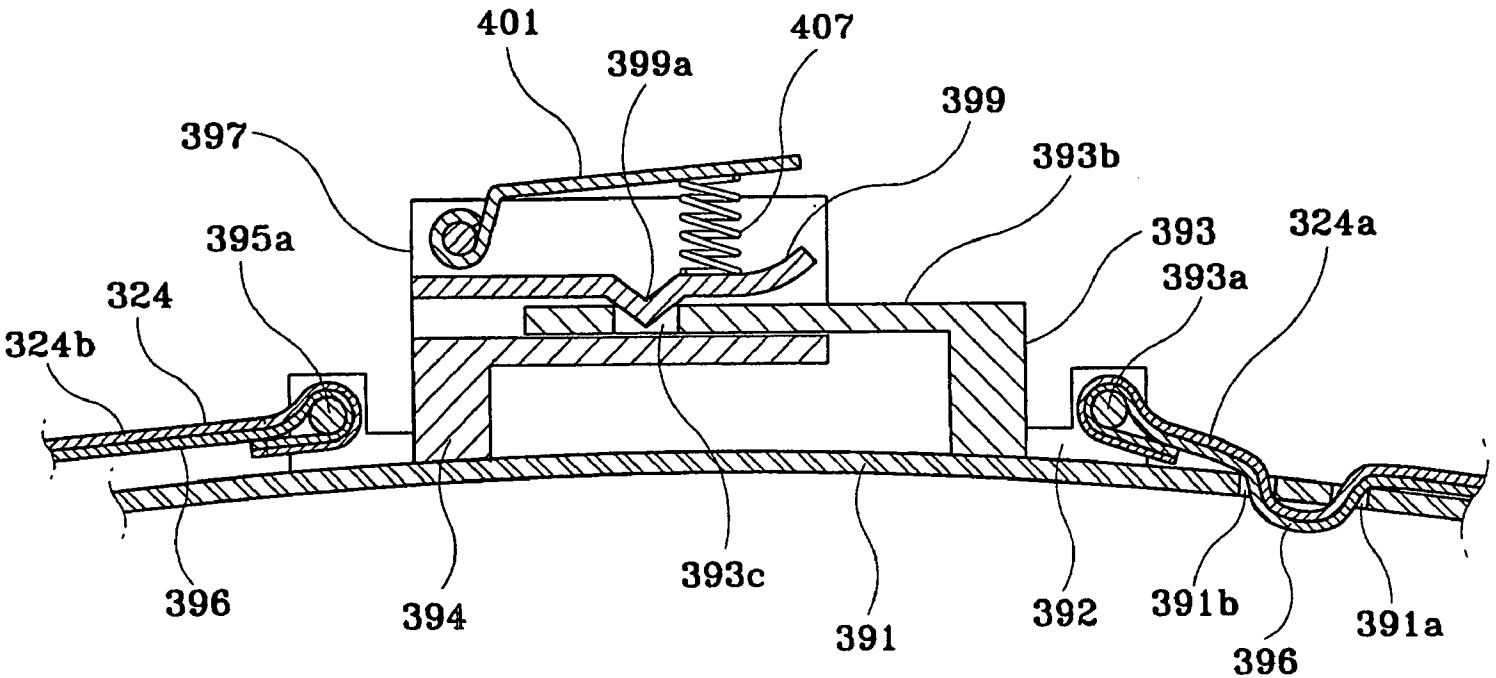
FIG. 25 is a cross-sectional view for illustrating the assembly of the connection unit shown in FIG. 24.

On the other hand, after being wound around the left and right bobbins 340, 342, the left and right chest bands 322, 324 are respectively moved in the left and right directions, passed through the guide and idle rollers 382, 382', 384, 384' and fixed at the fixed rollers 380, 380'. As shown in FIGS. 24 and 25, the left and right chest bands 322, 324 are separated at the center of one of the left and right chest bands by a connection unit 390 into flexible and fixed chest bands 324*a*, 324*b* for attachment and detachment.

The connection unit 390 is constructed with female and male connection units 392, 394 at both upper portions of the flexible base plate 391. A predetermined length of two long guide holes 391*a*, 391*b* are adjacently formed at the base plate surface of a place, which includes the female connection unit 392, for insertion and guide of the flexible chest band 324*a*.

The female connection unit 392 is a bracket 393 constructed with a rod 393*a* for hitching and fixing the flexible chest band 324*a* and a hitching plate 393*b* protruded toward the male connection unit 394 at the top portion of the bracket 393. The flexible chest band 324*a* is inserted and hitched at the guide long holes 391*a*, 391*b* and then sewn at the rod 393*a* for fixation. The bracket 393 is pulled and fastened at the fixed chest band 324*b*. There is a hitching hole 393*c* in the hitching plate 393*b*.

The male connection unit 394 includes a bracket 395 fixed at the base plate 391 with a rod 395*a* for hitching and fixing the fixed chest band 324*b*, a case 397 fixed over the bracket 395 for accommodation of the protruded plate 393*b*, a hitching plate 399 fixed at one end of the case 397 with a hitching plate 399*a* at the other end of the case 397 for insertion into the hitching hole 393*c* and a pressing plate 401 fastened over the hitching plate 399 via a spring 407 for releasing the locked state when the hitching plate 399 is pressed down. One end of the pressing plate 401 is hinged at the case 397.

An elastic skin protection band 396 is mounted on the internal surface of the chest band 318 to protect the patient's skin. The skin protection band 396 is wound onto the rollers and the left and right bobbins in the same way as the chest band 318.

A spiral spring 398 is mounted on the left and right axle members 336, 338 of the length adjusting means 326 with restoring force.

Furthermore, a locking axle 358 is spline-fastened at the other end of the driving axle 354 of the driving means 348 for attachment and detachment of the locking axle 358. The locking axle 358 is fixed at a piston 405, which moves according to the operation of the locking cylinder 403, for locking or unlocking with the driving axle 354. The locking axle 358 is fastened to a housing 402 via a ring-shaped slider 400 that moves only in the direction of the locking axle 358. The housing 402 is fixed at the lateral wall of the main body 312.

Hereinafter, a description will be made regarding the operation of the CPR apparatus thus constructed in accordance with the third embodiment of the present invention.

First, the pressing plate 401 of the connection unit 390 is pressed down to separate the hitching plate 399 from the protruded plate 393*b* of the female unit 392. In this state, the patient is lying in a flat, horizontal position with his back touching the support side 328 of the main body 312 and with his head supported by the head support unit 362. The female connection unit 392 is pulled in reverse order of the above separation process for connecting onto the male connection unit 394. At this time, the flexible chest band 324*a* is released from the left and right bobbins 340, 342, overcoming the restoring force of the spiral spring 398, and is adequately wound around the patient's chest.

The chest band 318 is attached to the patient's body by simple adjustments with the driving cylinder 355 of the driving means 348. The driving axle 354 is simply locked or unlocked via the locking cylinder 403.

When the cylinder 372 is operated by the control means (not shown) to lower the piston 314, the compression pad 370 compresses down the patient's chest to function as a cardiac pump. At the same time, the connection bracket 369 is lowered to fasten the patient's chest with the chest band 318, thereby functioning as a thoracic pump. The skin protection band 396 is elastic for attachment to the patient's body.

On the other hand, when the chest band 318 is wound onto the left and right bobbins 340, 342, the locked state of the locking cylinder 403 is released to drive the driving cylinder 350, the left and right bobbins 340, 342 are rotated by the driving gear 357, center gear 356 and electric gear 350 to wind the chest band 318. The operations of the piston 314 are the same as those described in accordance with the first embodiment of the present invention.

The CPR apparatus of the present invention may additionally include a tension control unit for checking and displaying a proper degree of tension when the chest band is wound around the patient, a unit for keeping the tension of the chest band constant, an auxiliary unit for protecting the woman's breasts, a control unit for adjusting the ratio between chest compression and artificial respiration, a pressure control unit for controlling the pressure of inhaled oxygen to prevent possible damage to the lungs when the artificial respiration is performed and a breathing amount control unit for controlling the amount of oxygen to be inhaled for keeping the amount of inhaled oxygen constant.

The present invention is not restricted to the preferred embodiments described above, but can be practiced with wide variations.

As described above, there are advantages in the CPR apparatus of the present invention in that the length of the chest band can be adjusted according to the size of the patient's chest, the patient's chest can be protected from excessive compression and the depth of the compression pad can be easily controlled.

What is claimed is:

1. A cardiopulmonary resuscitation apparatus comprising:

sternal compression means having a piston for compressing a patient's chest;

thoracic constriction means having a chest band for fastening and constricting the chest when said compression means compresses the sternum; and length adjusting means for adjusting the length of said chest band according to the size of a patient's chest, wherein said length adjusting means includes:

a bobbin for getting said chest band wounded on; a first ratchet wheel inserted and fixed at a bobbin axle;

a first stopper meshed with said first ratchet wheel for preventing reverse rotation of said bobbin;

a handle bracket inserted at the bobbin axle for free rotation, coupled with the first stopper to be guided and with a second ratchet wheel coupled at one side thereof;

a second stopper meshed with said second ratchet wheel for restricting rotation of said handle bracket, wherein said second stopper, ratchet wheel and handle bracket prevent said chest band from becoming loose or untied; and a spiral spring for giving rotational force to said bobbin.

2. The apparatus as defined in claim 1, wherein the thoracic constricting means includes a protection pad to be attached to a chest when said chest band is tightened.

3. The apparatus as defined in claim 1, wherein said sternal compressing means includes: a stopper having a plurality of restricting grooves for adjusting the level of said piston to be lowered; and a restricting member to be hitched at said restricting grooves in descending along with said dropping piston.

4. A cardiopulmonary resuscitation apparatus, the apparatus comprising:

sternal compression means having a piston for compressing a patient's chest; and thoracic constriction means having a chest band for fastening and constricting the chest when said sternal compression means compresses the sternum, wherein said chest band includes:

left and right chest bands divided for respectively winding around the left and right parts of the chest, a main body having a support side for closely supporting a patient's back and length adjusting means assembled at the main body for adjusting the length of said chest band according to the size of the patient's chest, said length adjusting means further including:

left and right bobbins for getting said left and right chest bands wound on after insertion through the center of the support side;

a spiral spring for giving restoring force to said left and right bobbins;

a single electric gear mounted on said the left and right bobbins for rotation of the left and right bobbins; and driving means for driving said electric gears and locking means for restricting rotation of said electric gears, wherein said driving means includes a center gear meshed to said electric gears for rotation, a driving axle coupled with said center gear, a driving gear inserted at said driving axle, and a cylinder having a rack gear for rotating said driving gear.

5. The apparatus as in claim 4, wherein said thoracic constriction means includes a protection pad for being attached to the chest when said chest band is fastened, and a skin protection band attached to the internal side of said chest band for protecting of the patient's skin.

* * * * *